US010502523B1

(12) United States Patent
Chester

(10) Patent No.: US 10,502,523 B1
(45) Date of Patent: Dec. 10, 2019

(54) HOLSTER WITH LOCKING HOOD

(71) Applicant: Point Blank Enterprises, Inc., Pompano Beach, FL (US)

(72) Inventor: Leroy Harry Chester, Boise, ID (US)

(73) Assignee: Point Blank Enterprises, Inc., Pompano Beach, FL (US)

( * ) Notice: Subject to any disclaimer, the term of this patent is extended or adjusted under 35 U.S.C. 154(b) by 0 days.

(21) Appl. No.: 16/252,601

(22) Filed: Jan. 19, 2019

(51) Int. Cl.
*F41C 33/04* (2006.01)
*F41C 33/02* (2006.01)

(52) U.S. Cl.
CPC ..... *F41C 33/0263* (2013.01); *F41C 33/0254* (2013.01); *F41C 33/041* (2013.01)

(58) Field of Classification Search
CPC ..... F41C 33/0263; F41C 33/0227; F41C 33/0218; F41C 33/0209; F41C 33/02; F41C 33/041
See application file for complete search history.

(56) References Cited

U.S. PATENT DOCUMENTS 5,501,381 A * 3/1996 Rogers ..... F41C 33/0227 224/196
6,371,341 B1 4/2002 Clifton, Jr.
6,769,581 B2 8/2004 Rogers et al.
6,886,725 B2 5/2005 Lowe et al.
7,140,523 B2 11/2006 Lowe et al.
7,461,765 B2 * 12/2008 French ..... F41C 33/0227 224/238
7,694,860 B2 4/2010 Clifton, Jr.
8,141,758 B2 * 3/2012 Spielberger ..... F41C 33/0263 224/238
8,235,263 B1 * 8/2012 Yeates ..... F41C 33/0263 224/193
8,631,981 B2 * 1/2014 Zusman ..... F41C 33/0227 224/243
8,807,404 B1 * 8/2014 Howell ..... F41C 33/0263 224/242
8,851,344 B2 10/2014 Baumann et al.
8,910,839 B2 12/2014 Clifton
9,322,612 B2 4/2016 Clifton, Jr.
9,494,384 B2 11/2016 Rogers et al.
9,541,348 B2 * 1/2017 Rogers ..... F41C 33/02
D784,008 S 4/2017 Rogers et al.
(Continued)

*Primary Examiner* — Corey N Skurdal
(74) *Attorney, Agent, or Firm* — Luccarelli & Musacchio LLP; Peter A. Luccarelli, Jr.

(57) ABSTRACT

A pivoting holster hood automatically locks over a handgun within the holster shell in a first pivot position and is selectively pivotable to a second position forward of the holster cavity upon depression of a reciprocating hood actuator that is coupled to a hood plate. A first spring cavity, defined by the first hood plate, and a second spring cavity, defined by the hood actuator are oriented in opposing communication, capturing a compression spring there between. The spring biases the second spring cavity and the hood actuator into a first reciprocated position, which locks the hood through mating engagement of a hood pawl and a notch of the holster shell. The hood actuator releases the hood pawl out of mating engagement with the shell notch, in opposition to the compression spring biasing force, unlocking the hood. In some embodiments, the hood automatically locks in the second position.

19 Claims, 10 Drawing Sheets

(56) References Cited

U.S. PATENT DOCUMENTS

| | | | | |
|---|---|---|---|---|
| 2007/0170215 | A1* | 7/2007 | Evans | F41A 17/00 224/192 |
| 2007/0181619 | A1* | 8/2007 | Seyfert | F41C 33/0227 224/196 |
| 2013/0075435 | A1* | 3/2013 | Hellweg | F41C 33/0227 224/243 |
| 2013/0306691 | A1 | 11/2013 | Baumann et al. | |
| 2018/0164072 | A1 | 6/2018 | McKendrick | |

* cited by examiner

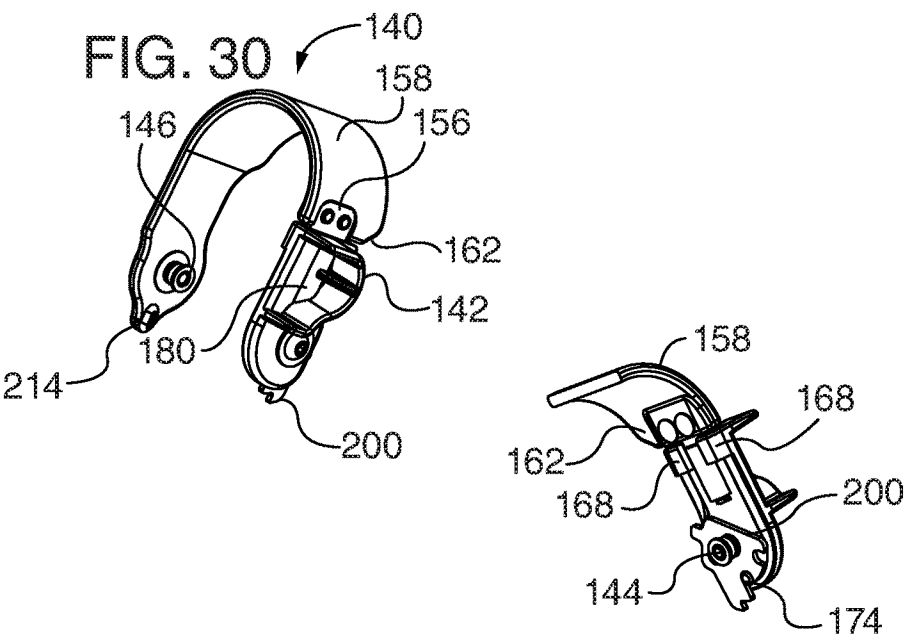
FIG. 30
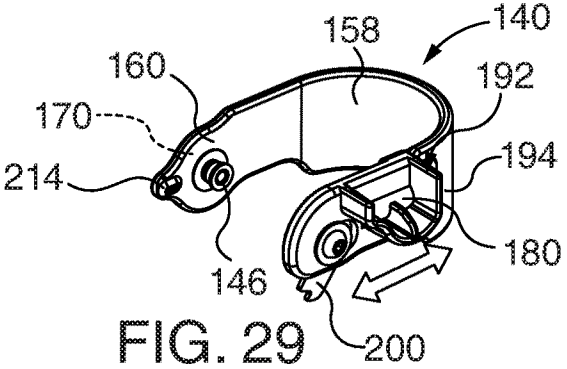
FIG. 29
FIG. 32
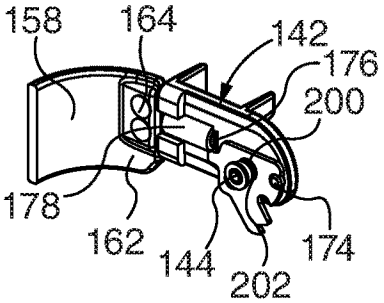
FIG. 31
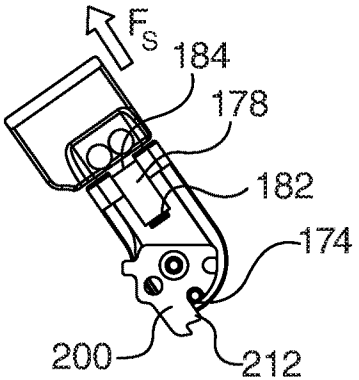
FIG. 39
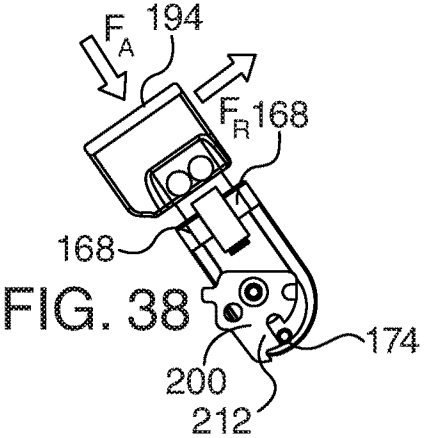
FIG. 38
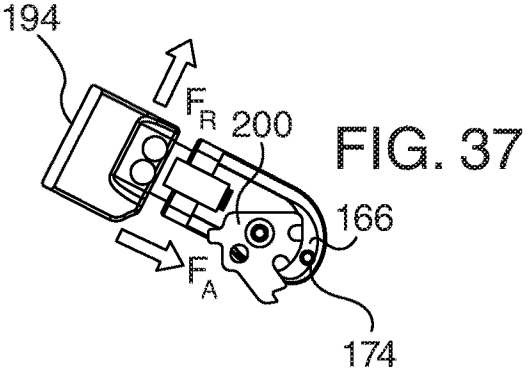
FIG. 37

HOLSTER WITH LOCKING HOOD

REFERENCE TO RELATED APPLICATION

This application incorporates by reference in its entirety United States utility patent application entitled "AUTO RETENTION HOLSTER", filed concurrently herewith and assigned Ser. No. 16/252,597 (filed Jan. 19, 2019).

TECHNICAL FIELD

The invention relates to holsters incorporating retention mechanisms for inhibiting unauthorized withdrawal of a handgun. More particularly, the invention relates to locking hoods for holsters that block unauthorized withdrawal of a handgun within the holster.

BACKGROUND

Many holster designs incorporate retention elements for inhibiting inadvertent, unintentional, or unauthorized withdrawal of a retained handgun without consent of the handgun bearer. One traditional handgun retention element in holsters is friction retention within the holster cavity, through tight interference fit of the holster shell (e.g., shell molding) about the handgun surface and/or addition of biasing elements (e.g., tension springs) in the holster shell. The handgun bearer selectively overcomes the friction force in the holster shell, in order to draw the handgun from the holster. Another traditional handgun retention element is an external restraining strap, flap, or lanyard loop affixed to the holster shell that blocks removal of the handgun. The handgun bearer selectively releases the securing strap prior to drawing the handgun.

Military and law enforcement personnel must balance conflicting objectives to secure handguns within their worn holsters from inadvertent dropping during high physical exertion in the field and from unauthorized access by criminal suspects or enemy combatants, while maintaining ability to draw them quickly, under intense psychological pressure, in response to violent threats. Friction tension alone is often not considered satisfactory to prevent inadvertent dropping under high physical exertion or to prevent access by a determined aggressor. Externally accessible security straps are relatively slow for the gun bearer to release under violent stress, yet they are too easily accessible to a determined aggressor who is trying to disarm the gun wearer by snatching the handgun from the holster.

Responsive to the need to balance handgun security retention with speed of draw for law enforcement and military personnel, holster security retention features have been designed that are accessible to the handgun bearer's primary gun holding hand, yet relatively less accessible by aggressors positioned away from the handgun bearer. Some holster designs have incorporated pivoting hoods that in a locked vertical position block the retraction or draw path of a handgun out of the holster cavity. The pivoting hood is unlocked and pivoted forward by the handgun bearer, clearing withdrawal path of the handgun. Other holster designs, such as those shown in U.S. Pat. No. 6,886,725, and in U.S. Pat. No. 7,140,523 incorporate automatic locking features that engage within or against structural features of handgun surface, such as trigger guards, ejection ports, cylinders, or slide lightening holes. The automatic locking element blocks and prevents removal of the handgun from the holster shell until the handgun bearer selectively releases it—typically by thumb, index, or middle finger manipulation of a lever or button.

There is a growing trend within law enforcement and military services to mandate holsters with multiple, sequences of retention element deactivation, making it more difficult for an aggressor to disarm the handgun bearer, while conversely giving the handgun bearer more time to subdue the aggressor. Thus, a retention holster may employ sequentially one or more manipulations of a pivoting hood, followed by one or more manipulations of a releasing lever for an automatic lock, followed by overcoming friction retention against the handgun within the holster cavity.

SUMMARY

Exemplary holster embodiments described herein include a pivoting holster hood that automatically locks over a handgun within the holster shell in a first pivot position and that is selectively pivotable to a second position forward of the holster cavity upon depression of a reciprocating hood actuator coupled to an elongated, non-reciprocating, first hood plate of the hood A first spring cavity, defined by the first hood plate, and a second spring cavity, defined by the hood actuator are oriented in opposing communication, capturing a compression spring there between. The compression spring biases the second spring cavity and the hood actuator into a first reciprocated position, which locks the hood through mating engagement of a hood pawl and a first notch that is coupled to the holster shell. In various embodiments, the first notch is formed directly in the holster shell, or in a plate or other notch-defining structure that is embedded within or affixed to the holster shell. The hood actuator releases the hood pawl out of mating engagement with the first notch of the holster shell, in opposition to biasing force generated by the compression spring, unlocking the hood. In some embodiments, the hood is lockable only in the first pivot position. In other embodiments, the hood is lockable in more than one pivot position, by inclusion of additional notches that mate with the pawl. In some embodiments, the pawl is oriented on the holster shell and the notch is oriented on the holster hood plate.

Exemplary embodiments of the invention feature a holster for selectively retaining a handgun, which includes a holster shell having opposing front and rear walls and opposing first and second sidewalls. Those walls collectively define upper, lower, inner, and outer surfaces, with the inner surface defining a holster cavity. A first journal is coupled to and projects from one of the first or second sidewalls. A hood is selectively pivotable about a fixed journal axis established by the first journal. The hood has a first pivot position above the holster cavity, for blocking handgun insertion into or withdrawal from the holster cavity, and a second position forward of the holster cavity, toward the front wall of the holster, for allowing insertion or withdrawal of a handgun. The hood has an elongated, non-reciprocating, first hood plate, having a first end pivotally coupled to the first journal about the fixed journal axis, a second end, and a first axis between those respective ends. A hood actuator is coupled to the non-reciprocating, first hood plate. The hood actuator is reciprocable along the first hood plate, from a first reciprocated position, wherein its distal end is oriented closer to the first journal, and a second reciprocated position, wherein the distal end is oriented farther away from the first journal. A first spring cavity is defined by the first hood plate, intermediate location of the first hood plate coupling with the first journal and its second end. A second spring cavity, defined by the hood actuator, is oriented intermediate the first journal and the proximal end of the hood actuator, in opposing communication with the first spring cavity, between the first and second reciprocated positions. A compression spring is captured within the first and second spring cavities, biasing the second spring cavity and the hood actuator away from the journal into the first reciprocated position. A hood pawl or a hood notch is coupled to the hood actuator. A first notch or first pawl is coupled to the holster shell, in mating engagement with the corresponding opposing hood pawl or hood notch when the holster hood is concurrently in the first pivot and first reciprocated positions, and disengaged when the holster hood is in the second reciprocated position. In various embodiments, the first notch is formed directly in the holster shell, or in a plate or other notch-defining structure that is embedded within or affixed to the holster shell. In some embodiments, the hood is lockable only in the first pivot position. In other embodiments, the hood is lockable in more than one pivot position, by inclusion of additional notches that mate with the pawl.

Other exemplary embodiments of the invention feature a holster for selectively retaining a handgun, which includes a holster shell having opposing front and rear walls and opposing first and second sidewalls. The walls collectively define upper, lower, inner, and outer surfaces with the inner surface defining a holster cavity. First and second journals are concentrically aligned along a journal axis; they are coupled to and project from the first and second sidewalls. A U-shaped hood is selectively pivotable about the first and second journals; it has a first pivot position above the holster cavity, for blocking insertion into or withdrawal of a handgun from the holster cavity, and a second position forward of the holster cavity, toward the front wall of the holster, for allowing insertion or withdrawal of a handgun. The hood has a first, elongated, non-reciprocating hood plate and a parallel, second elongated hood plate or strap ("second plate/strap") with conjoined respective second ends. A first end of the first hood plate is pivotally coupled to the first journal, about the fixed journal axis, and a first end of the second plate/strap is pivotally coupled to the second journal about the fixed journal axis. A hood actuator is coupled to the first, non-reciprocating hood plate; it has a proximal end oriented closer to the second end of the first hood plate and a distal end closer to the first end thereof. The hood actuator defines a first elongated slot circumscribing the first journal that is oriented parallel to the first axis of the first hood plate, intermediate their proximal and distal ends. A hood actuator is reciprocable along the first elongated slot, from a first reciprocated position, wherein the distal end thereof is oriented closer to the first journal, and a second reciprocated position, wherein the distal end thereof is oriented farther away from the first journal. A first spring cavity is defined by the first hood plate, intermediate location of the first hood plate coupling with the first journal and its second end. A second spring cavity, defined by the hood actuator, is oriented intermediate the first journal and the proximal end of the hood actuator, in opposing communication with the first spring cavity between the first and second reciprocated positions. A compression spring is captured within the first and second spring cavities, biasing the second spring cavity and the hood actuator away from the first journal into the first reciprocated position. A hood pawl is coupled to the hood actuator. A first notch is coupled to the holster shell, in mating engagement with the hood pawl when the holster hood is concurrently in the first pivot and first reciprocated positions, and disengaged when the holster hood is in the second reciprocated position. In some embodiments, a second notch is coupled to the holster shell, in mating engagement with the hood pawl, when the holster hood is concurrently in the second pivot and first reciprocated positions, and disengaged when the holster hood is in the second reciprocated position. In various embodiments, the first and/or the second notch is formed directly in the holster shell, or in a plate or other notch-defining structure that is embedded within or affixed to the holster shell.

The respective features of the exemplary embodiments of the invention that are described herein may be applied jointly or severally in any combination or sub-combination.

BRIEF DESCRIPTION OF DRAWINGS

The exemplary embodiments of the invention are further described in the following detailed description in conjunction with the accompanying drawings, in which:

FIGS. 29 and 30 are perspective views of a hood assembly, its hood actuator in a locked orientation;

FIG. 31 is a perspective view of the hood assembly in the first pivot position of FIG. 22, its hood actuator in a locked orientation;

FIG. 32 is a perspective view of the hood assembly in the second pivot position of FIG. 25, its hood actuator in a locked orientation;

FIGS. 37-39, in combination with preceding FIGS. 33 and 35 show range of motion of the hood assembly and its hood actuator, from the locked, first pivot position of FIG. 33, blocking the holster cavity, then transitioning in FIGS. 35, 37, and 38 in unlocked state, to the locked, second pivot position of FIG. 39, forward of the holster cavity.

To facilitate understanding, identical reference numerals have been used, where possible, to designate identical elements that are common to the figures. The figures are not drawn to scale.

DESCRIPTION OF EMBODIMENTS

Figure 1:
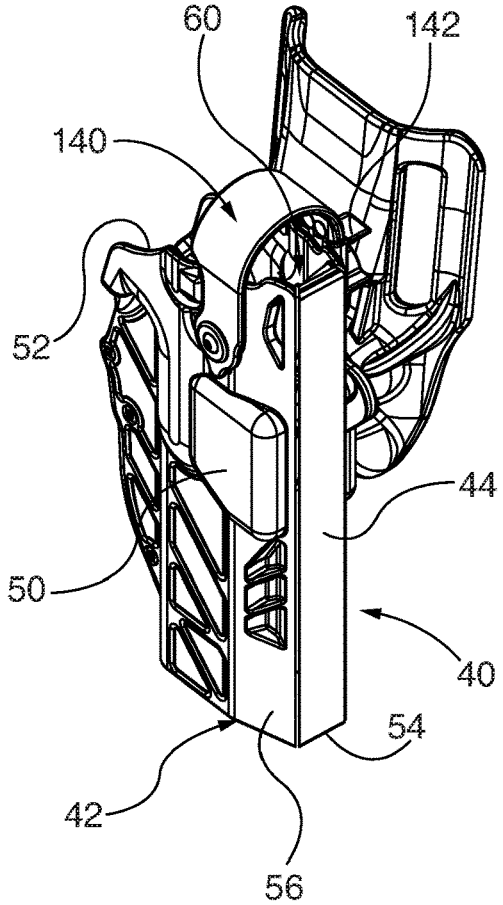
FIG. 1 is a perspective view of the front wall and outboard facing sidewall of a holster constructed in accordance with embodiments described herein, with the holster hood in its first pivot position.

Exemplary embodiments described herein are utilized in retention holsters for handguns. Some embodiments automatically lock inserted handguns within the holster cavity by mating a pivoting retention block into engagement with a surface feature of the handgun that is remote from its trigger guard, such as an ejection port or gas port or a slide-lightening aperture, or a revolver cylinder. The handgun is unlocked by thumb pressure during a handgun draw stroke, or some other type of digital manipulation of a retention-block release lever that is accessible to the holster wearer on an inboard sidewall of the holster shell. The retention-block release lever is not readily accessible to others who are not wearing the holster.

Other exemplary handgun retention embodiments shield the handgun with a pivotable, locking hood assembly. When the hood assembly is locked in a first pivotal position over the holster cavity, it prevents extraction of the handgun from the holster, until it is unlocked by the holster wearer. During a draw stroke, the wearer must execute a first thumb pressing or other finger digit manipulation on a hood actuator and then pivot the hood assembly forward, clear of the holster cavity, by a second thumb or other digit rocking manipulation. Both the thumb press and rock manipulations are complimentary to instinctive hand and finger motions made while grasping the handgun during an initial phase of the draw stroke.

Other exemplary handgun retention embodiments incorporate all of the automatic retention and pivoting hood features described herein, which require three distinct thumb manipulations to draw the handgun from the holster shell. In such combination embodiments, the thumb release surface of the hood assembly and the thumb pad of the retention-block release lever are aligned along a common plane between the inboard sidewall of the holster shell and the holster's belt hanger. During the initial gun-grasping portion of the draw stroke, the holster wearer's thumb instinctively travels along the same planar path from the hood assembly's thumb release surface to the pad of the retention-block release lever as the handgun wearer's fingers complete grip around the front strap and back strap of the handgun.

The holster 40 of FIGS. 1-6 includes a holster shell 42 having opposing front 44 and rear 46 walls and opposing first (inboard) 48 and second (outboard) 50 sidewalls. The walls of the holster shell 42 collectively defining upper 52, lower 54, outer 56, and inner 58 surfaces. The inner surface 58 defines a handgun-receiving holster cavity 60. A belt hanger 62 is coupled to the holster shell 42 and belt hanger adapter 64 with fasteners 66. In some embodiments, selective, matched sizing of the modular construction belt hanger 62 and the belt hanger adapter 64 modular components facilitates adjustment of the holster 40 drop, offset and cant to match stature of the gun bearer.

Referring to FIGS. 2, 5, and 7-15, the holster 40 incorporates a retention block, automatic locking system 68 with a retention-block release lever 70 (the "lever 70") that is oriented on the outer surface 56 of the first (inboard) sidewall 48 of the holster shell 42. The release lever 70 is coupled to a pivoting retention block 72, mounted inside the handgun-receiving holster cavity 60, by an axle 74 that is pivotally retained within an access passage 76 formed through the first sidewall 48 of the holster shell 42, from its outer surface 56 to its inner surface 58. Axle 74 has left and right mirrored symmetry, with a castellated axial tip 77 that is in mating engagement with a corresponding castellated surface 78 of the lever 70. In this manner, the lever 70 can be coupled on the left or right side of the retention block 72, for use in either left-handed or right-handed shooters. Screw 80 fastens the lever 70 to the retention block 72. The entire retention block 72 is mounted within the holster shell 42, with only the castellated axial tip 77 accessible outside the holster shell through the access passage 76. The lever 70 selectively pivots the retention block along a pivot axis intersecting the first (inboard) 48 and second (outboard) 50 sidewalls of the holster shell 42 between a locked position, shown in FIGS. 7-10, and an unlocked position, shown in FIGS. 11 and 12. The retention block 72 has an inclined surface 82 facing the rear wall 46 of the holster shell 42, for abutment against a handgun as it is inserted within the holster cavity 60, so that the retention block pivots toward the front wall 44 of the holster shell during handgun insertion.

Figure 9:
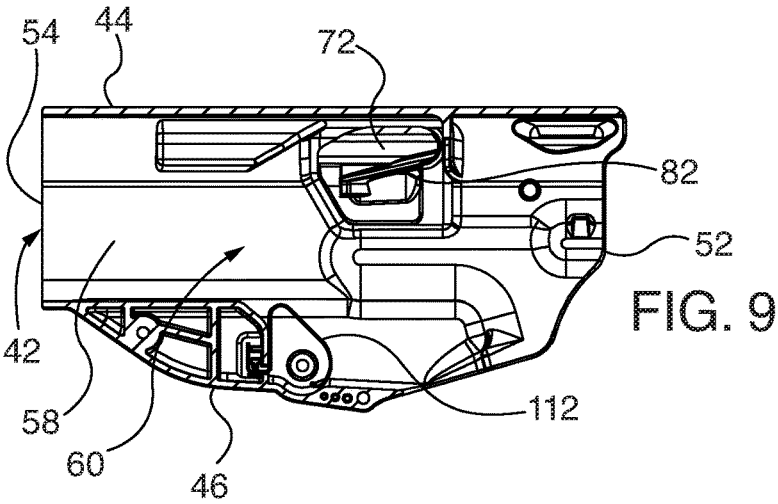
FIG. 9 is a cross section of the holster of FIG. 7, taken along 9-9 of FIG. 8, showing the retention block in its locked position.
Figure 10:
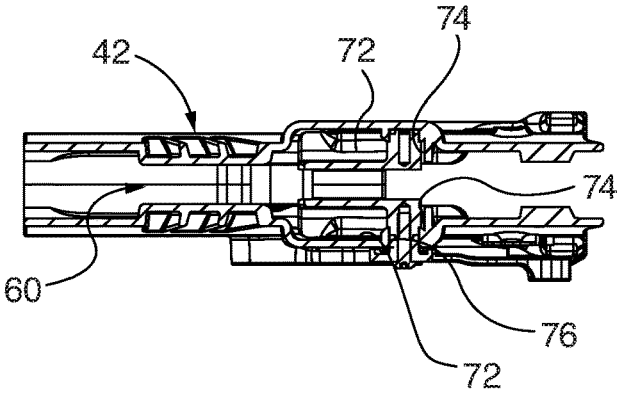
FIG. 10 is a cross section of the holster of FIG. 7, taken along 10-10 of FIG. 7.
Figure 16:
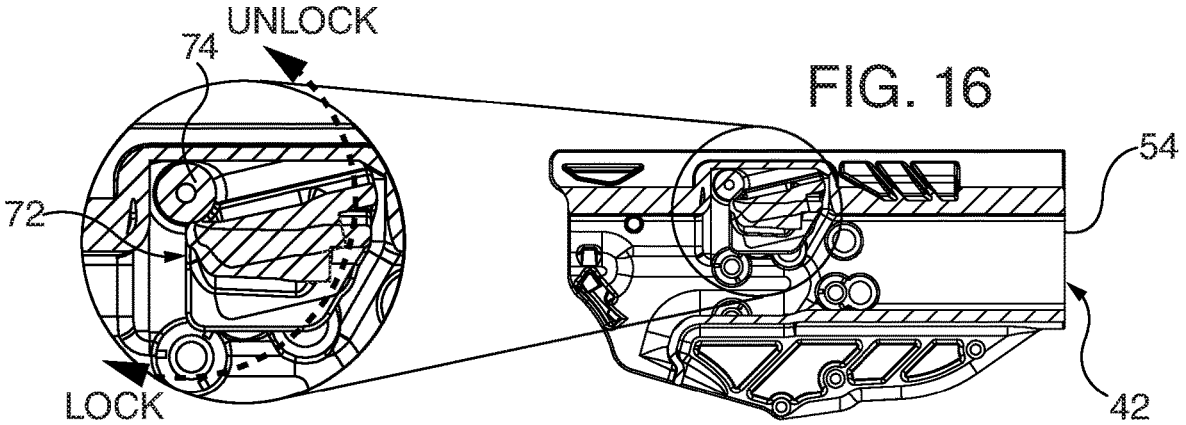
FIG. 16 is a cross section composite of FIGS. 9 and 12 and an enlarged detailed view showing the retention block in its locked and unlocked positions.
Figure 17:
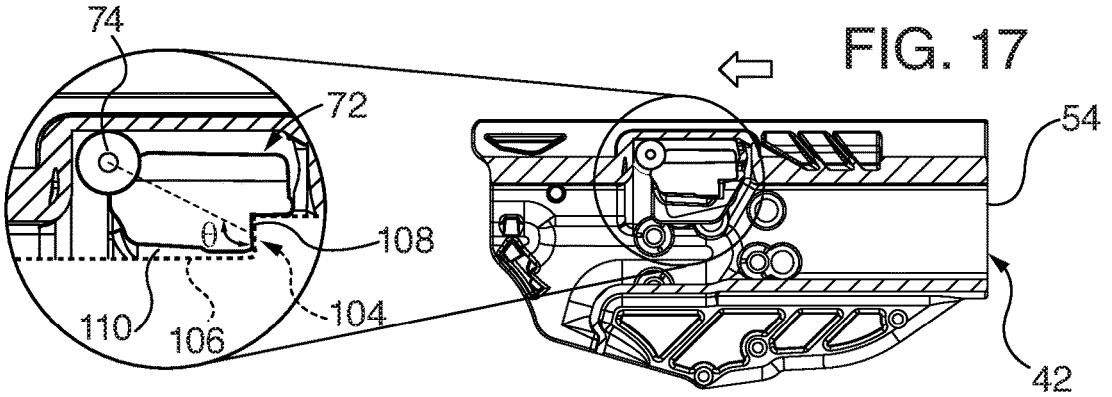
FIG. 17 is a schematic view of the retention block in its locked position, with handgun engagement surfaces formed in the retention block in mating engagement with an ejection port of a handgun.

A torsional spring, namely the spiral or clock spring 84 biases the retention block 72 into the locked position of FIGS. 9, 16 and 17. Referring to FIGS. 11, and 13-15, the spring 84 has a center passage 86 that circumscribes the axle 74, with a first spring end 88 coupled to an aperture 90 formed in the retention-block release lever 70. The spring 84 is captured within a lever cavity 92. A second spring end 94 is coupled to a spring retention stud 96 on the outer surface of the first sidewall 48 of the holster shell 42. Orientation of the spring 84 within the lever cavity 92 aligns planar range of the spring's motion with the planar range of motion of the pivoting lever 70. This planar alignment improves the user's tactile feedback in his or her thumb, as compared to known release lever designs that incorporate biasing springs within the holster cavity. In other embodiments, the spring for biasing the retention block into its locked position is a spiral wound torsional spring or a leaf spring, or a coil spring. In other embodiments, the first spring end 88 is coupled to the axle 74, rather than to the retention-block release lever 70, preferably in planar alignment with the release lever's range of motion, but not limited to such specific alignment.

Referring to FIGS. 11, and 13-15, the lever 70 has a projecting flange 98 that is engaged within a track 100. The flange 98 and track 100 engagement advantageously cause the thumb pad 102 of the lever 70 to pivot in an arcuate path, along a plane that is generally parallel to the outer surface of the first sidewall 48 of the holster shell 42. The arcuate path of the thumb pad 102 coincides with natural thumb articulation as a shooter grips a handgun within the holster 40. In this way, the shooter efficiently and simultaneously grips the handgun and unlocks the retention block 72.

Figure 40:
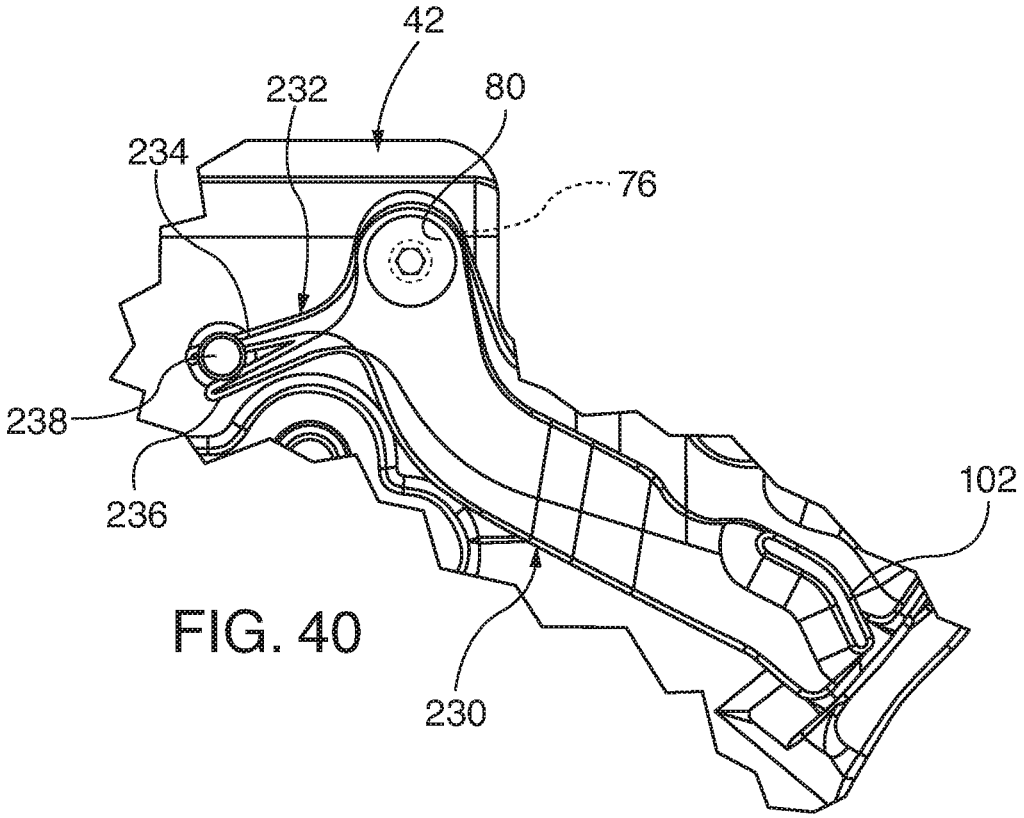
FIGS. 40 and 41 are fragmented views of alternative embodiments of retention-block release levers.
Figure 41:
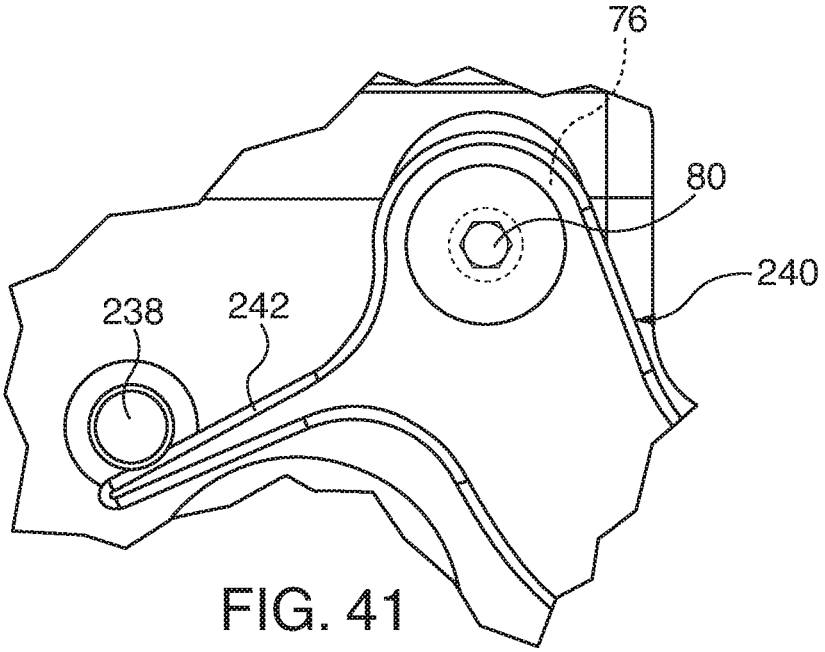

Alternative embodiment retention-block release levers 230 and 240 are shown, respectively, in FIGS. 40 and 41. These lever embodiments substitute cantilever-like, spring biasing elements for the spring 84 in the lever cavity 92 of the retention-block release lever 70. Specifically, the lever 230 incorporates a forked, cantilever-like spring 232, where the upper 234 and lower 236 tines straddle a fixed lever post 238. The lever 240 incorporates a bird beak-like, single cantilever spring 242, which abuts against post 238. The springs 232 and 242 are integrally formed within their respective lever structures 230 and 240. In other embodiments, the springs 232 and 242 are separate components (e.g., metallic leaf springs) that are coupled to their respective lever structures. Other structural and functional features of the lever 70 embodiment are incorporated in the lever embodiments 230 and 240, including the thumb pad 102 and the coupling with the axle of the retention block (not shown) by screw 80, through the aperture 76 in the holster shell 42.

Figure 11:
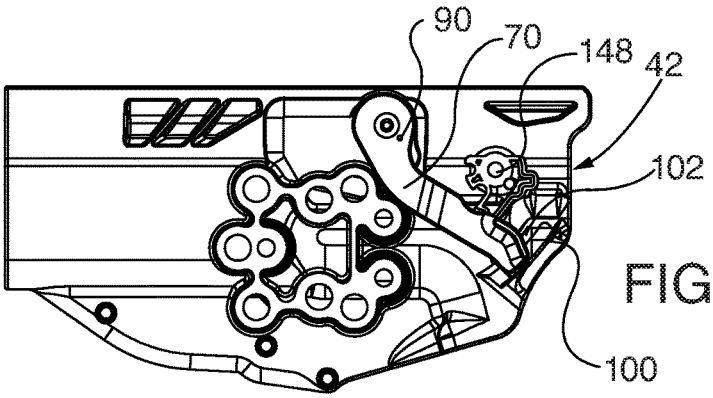
FIG. 11 is a plan view of the inboard sidewall of the holster shell of FIG. 7, with the retention-block release lever in its unlocked position.
Figure 12:
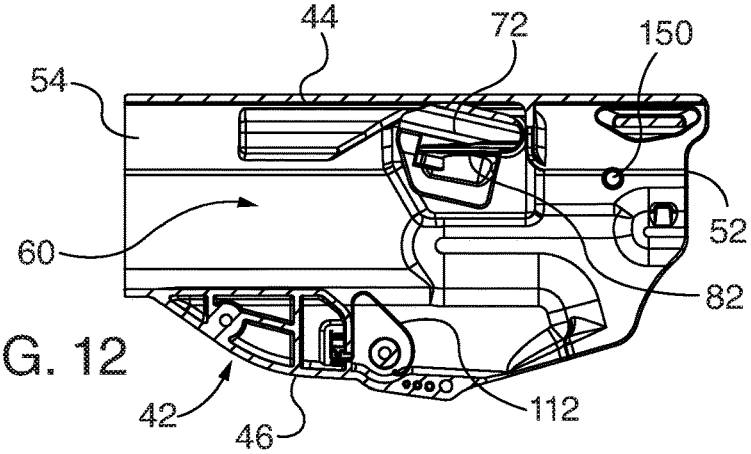
FIG. 12 is a cross section of the holster of FIG. 11, showing the retention block in its unlocked position.
Figure 13:
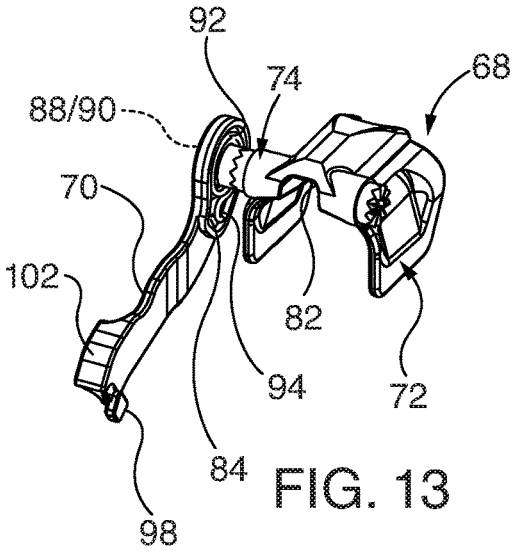
FIG. 13 is a perspective view of the retention block and retention-block release lever assembly of FIGS. 7-12.
Figure 14:
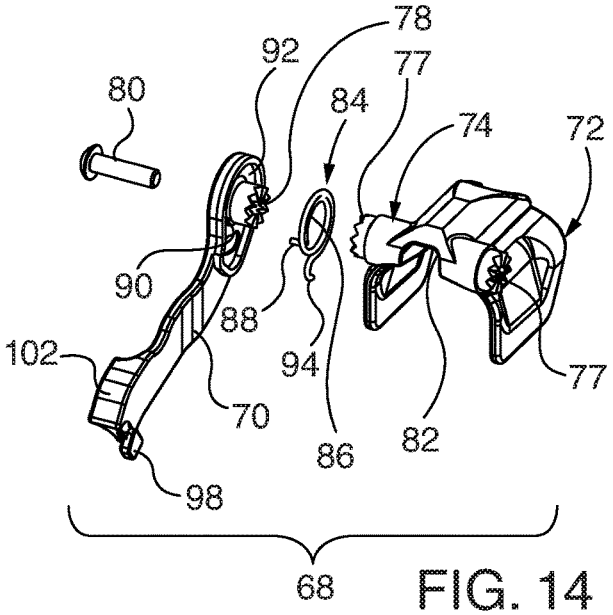
FIG. 14 is an exploded view of the retention block and retention-block release lever components of FIG. 13.
Figure 15:
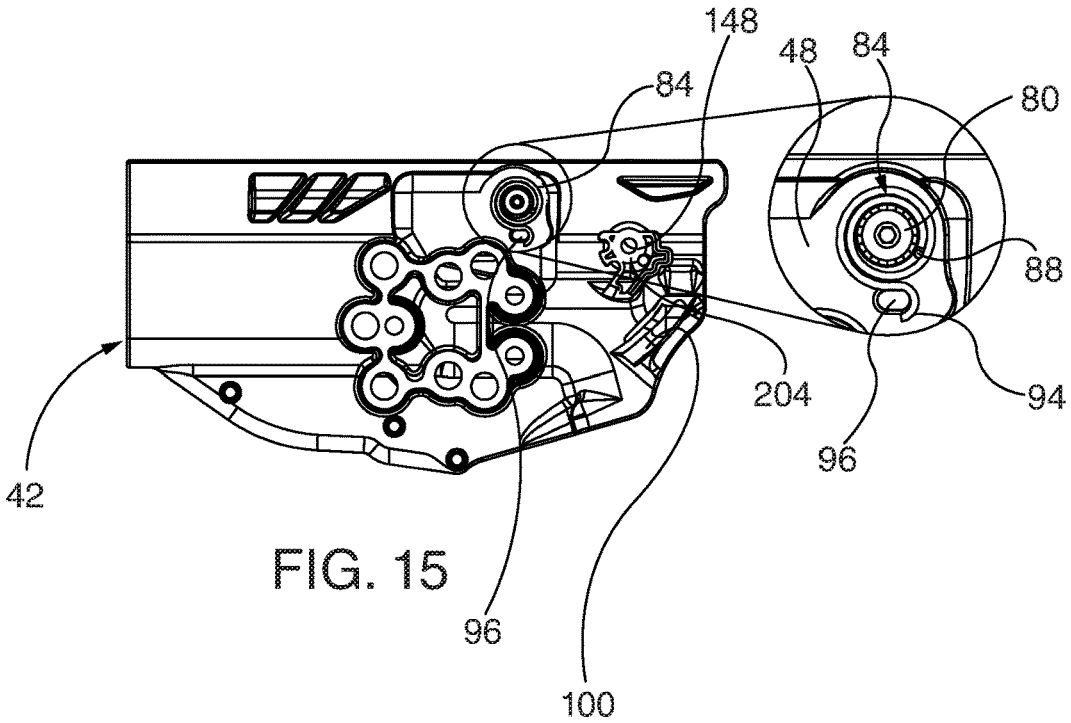
FIG. 15 is a plan view and enlarged detailed view of the inboard sidewall of the holster shell of FIGS. 7 and 11, without the retention-block release lever, showing an embodiment of a spiral or clock spring for biasing the retention block in its locked position.

Structure and kinematics of the pivoting retention block 72 and its engagement with a surface feature of a handgun that is inserted within the handgun-retaining holster cavity 60 are now described, with reference to FIGS. 9, 11, and 16-18. In FIGS. 9 and 11 the muzzle end or lower surface 54 of the holster shell 42 is on their left side, whereas it is on the right side in FIGS. 16-18. In the exemplary embodiment of these figures, the handgun is a semi-automatic pistol with a slide 104; the surface feature that is engaged by the retention block 72 is an ejection port 106. Both the slide 104 and its ejection port 106 are shown in phantom in FIGS. 17 and 18. For point of reference, the muzzle end of the slide is to the right in FIGS. 17 and 18. In other embodiments, the surface feature of the handgun is a slide vent port, slide-lightening slot, gas vent port, convex or concave surface feature specifically designed for mating engagement with a retention block, or a revolver cylinder. The retention block 72 has a handgun engagement surface 108, whose profile and orientation is approximately tangential to the radius of its rotational path (shown in dotted lines). In some embodiments, the angle θ between the radius and the engagement surface 108 is over 90 degrees to 93 degrees, for positive engagement between the engagement surface and the mating surface of the ejection port 106. In some embodiments, the underside 110 of the retention block 72 has a profile matching that of the corresponding ejection port 106 profile. A handgun-biasing element, such as the leaf spring 112 is oriented within the holster cavity 60. Other embodiments of handgun biasing elements include torsional or compression springs, or compressible polymers, spring-loaded rollers, or spring-loaded ball bearings. When a handgun is inserted into the holster cavity, the leaf spring 112 contacts the frame, biasing the ejection port 106, or any other surface feature that is remote from its trigger guard, into biased engagement against the engagement surface 108 and underside 110 of the retention block 72. In some embodiments, the biasing force generated by the leaf spring 112 also tensions the handgun against the inner surface 58 of the holster shell 42.

Figure 2:
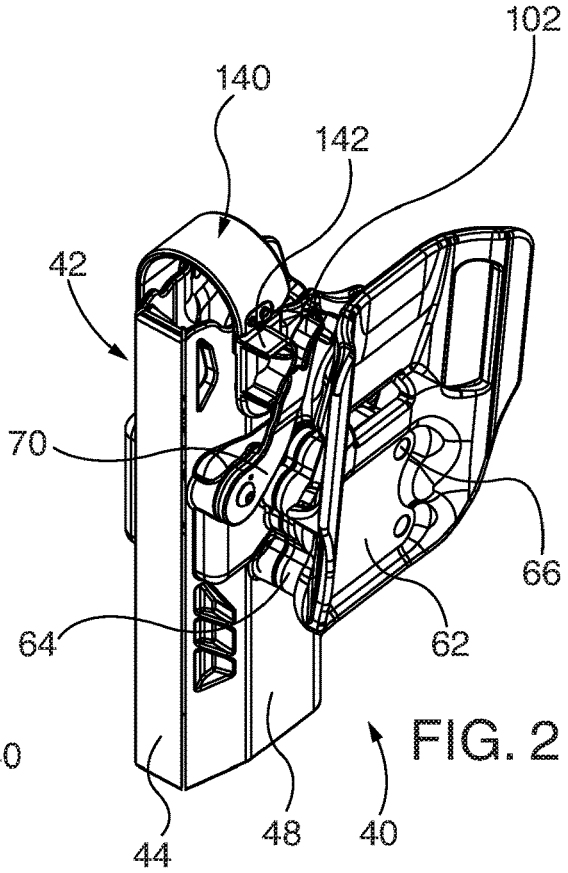
FIG. 2 is a perspective view of the front wall and inboard-facing sidewall of the holster of FIG. 1, showing the retention-block release lever.
Figure 3:
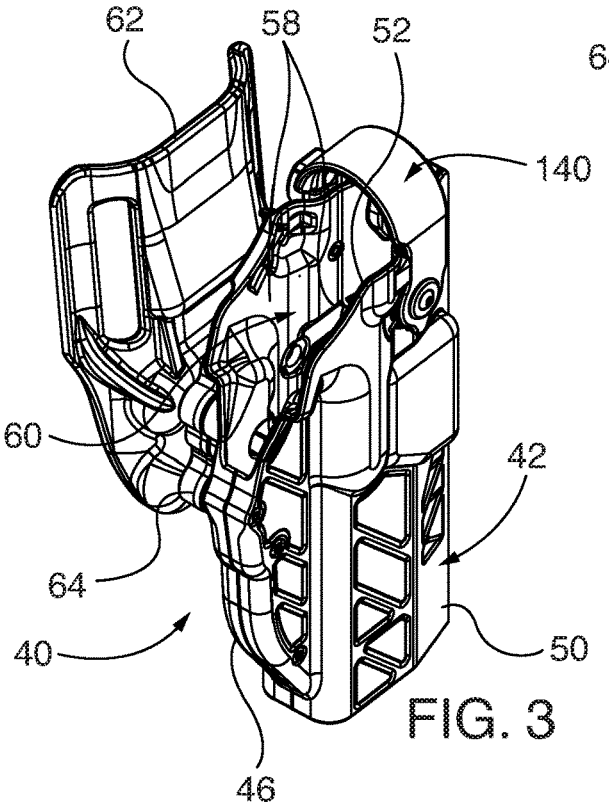
FIG. 3 is a perspective view of the rear wall and outboard-facing sidewall of the holster of FIG. 1.

When the retention block 72 is in its locked position, FIG. 17, the engagement surface 108 is cammed over center. Any attempt by an unauthorized aggressor to grab and retrieve the handgun out of the holster (i.e., to the left in FIGS. 16 and 17), without releasing the retention block 72 with the release lever 70, wedges the retention block in a compressive state, against the slide 104 and into the ejection port 106. When the handgun engagement surface 108 is pivoting from its unlocked position into its locked position, or when it is being wedged against the slide 104 and into the ejection port 106, it translates both axially towards the upper surface 52 of the holster shell 42 and tangentially towards the rear wall 46 of the holster shell. It will be difficult, if not impossible; to unlock the retention block until the aggressor ceases the attempt to retrieve the handgun. This gives the handgun wearer precious additional time to react to the unauthorized gun retrieval by stopping the aggression. As shown in FIGS. 2 and 3, the release lever 70 is only readily accessible by the holster wear's thumb, in the small confines of the well or tunnel between the holster shell 42 and the belt hanger 62. Aggressors cannot easily access the release lever 70 from the front 44, rear 46, or outboard second sidewall 50, of the holster 40. Authorized actuation of the release lever 70, by the holster wearer's translation of the thumb pad 102 quickly unlocks the retention block as the wearer's hand is acquiring a grip on the pistol.

Figure 18:
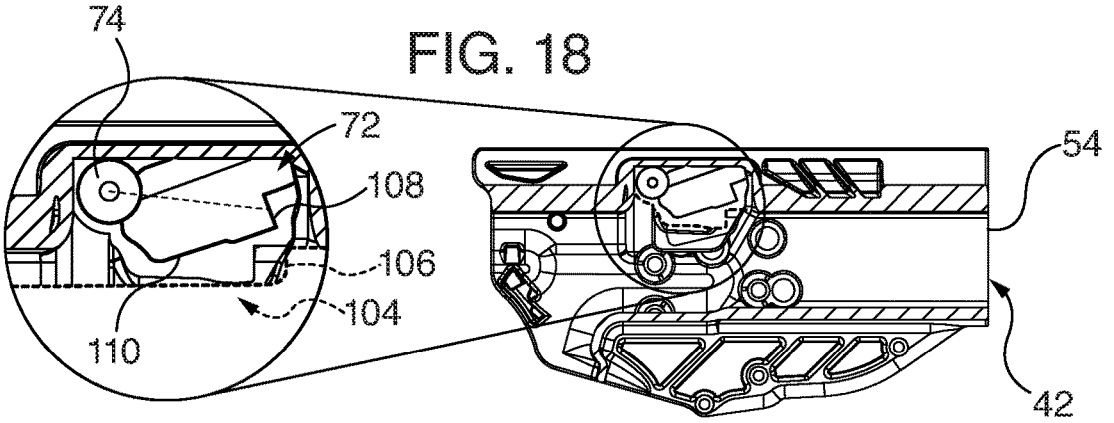
FIG. 18 is a schematic view of the retention block in its unlocked position, with handgun engagement surfaces formed in the retention block disengaged from the ejection port of a handgun.

Referring to FIGS. 9-11, and 16-18, translation of the thumb pad 102 correspondingly pivots the retention block 72 from their respective locked positions of FIGS. 9 and 17 to their unlocked positions of FIGS. 11 and 18. As the retention block 72 pivots about its axle 74 from its locked position to its unlocked position, the handgun engagement surface 108 translates both axially towards the muzzle end; lower surface 54 of the holster shell 42 and tangentially towards the front wall 44 of the holster shell. Biasing force of the handgun-biasing element or leaf spring 112 resists the axial translation component of the handgun engagement surface 108 as the retention block 72 rotates towards its unlocked position. However, in the holster embodiments described herein, it is not necessary to apply external translation force on the handgun, e.g., by pushing the handgun deeper into the holster cavity 60 toward its muzzle end, in order to overcome the biasing force of the leaf spring 112. Rather, the retention block 72 is rotated to its unlocked position solely by actuation of the retention-block release lever 70, through thumb pressure on its thumb pad 102. Thumb pressure overcomes the combined biasing forces of the handgun-biasing element or leaf spring 112 and the retention block biasing spring 84.

Referring to FIGS. 2, 7, 9, 11, 12, and 16-18, a handgun is inserted into the holster 40, automatically locked by the retention block 72 within the holster cavity 60, and thereafter selectively drawn from the holster by manipulation of the thumb pad 102 of the retention-block release lever 70 as follows. A handgun is inserted into the handgun-receiving holster cavity 60 of the holster shell 42. As the handgun is inserted, handgun slide 104 abuts against the inclined surface 82 of the retention block 72, pivoting the latter into to the unlocked position of FIGS. 16 and 18, resisted by torsional biasing force generated by the spring 84. Combined biasing forces of the spring 84 and the handgun-biasing leaf spring 112 bias the handgun engagement surface 108 of the retention block 72 against the slide 104 and ejection port 106 of the handgun, remote from its trigger guard, into the locked position of FIGS. 16 and 17 automatically locking and preventing withdrawal of the handgun from the holster shell 42. The handgun is selectively withdrawn from the holster shell 42, by moving the retention block 72 to its unlocked position through manipulation of the thumb pad 102 of the retention-block release lever 70.

Figure 19:
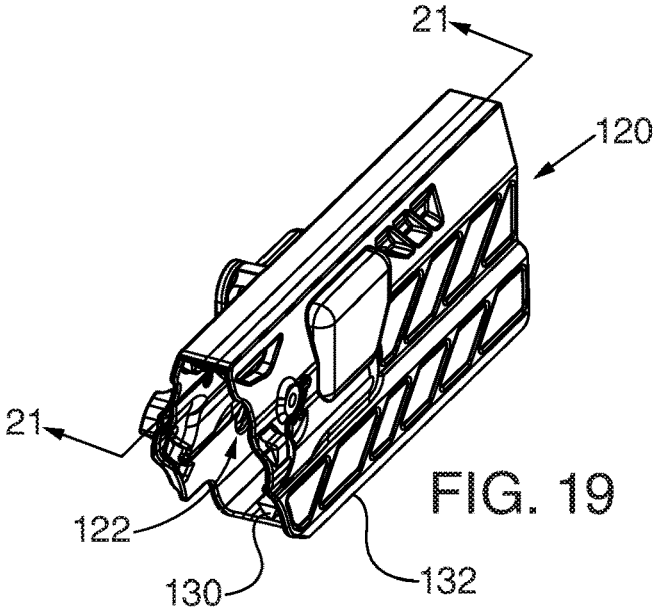
FIG. 19 is a perspective view of a front wall and outboard facing sidewall of a holster shell constructed for retaining a handgun with a trigger guard- and/or lower frame-mounted illumination device, without a holster hood, in accordance with embodiments described herein.
Figure 20:
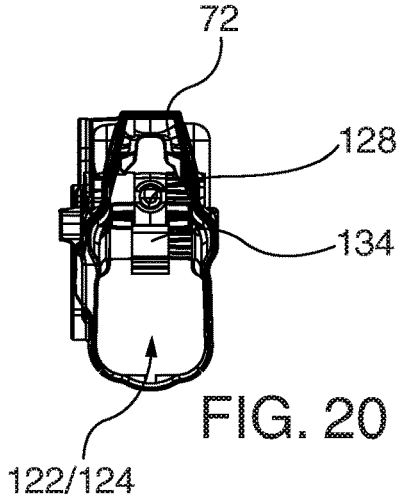
FIG. 20 is a top plan view of the holster shell of FIG. 19.
Figure 21:
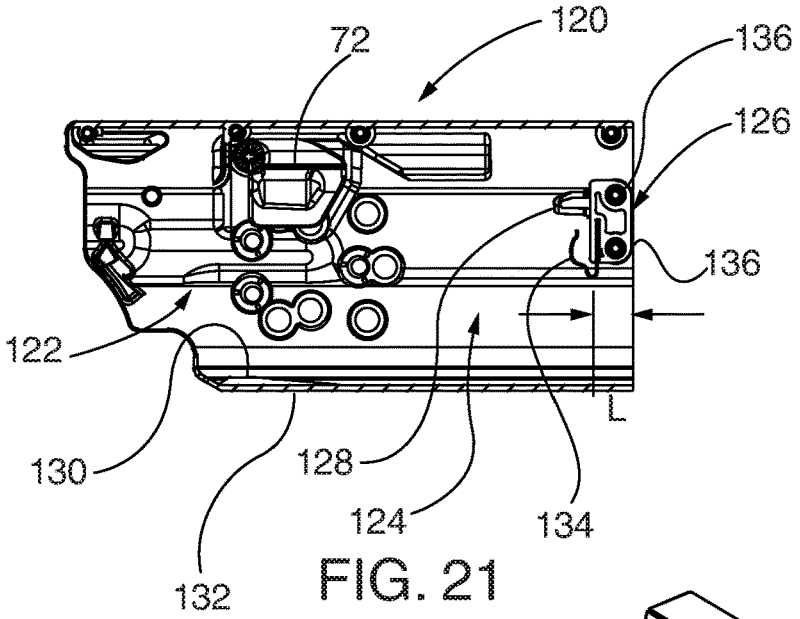
FIG. 21 is a cross section of the holster shell of FIG. 19, taken along 21-21 thereof.
Figure 28:
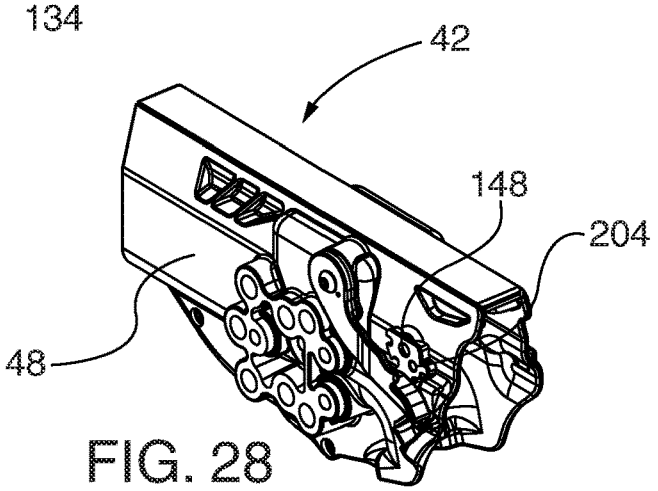
FIG. 28 is a perspective view of the inboard side of the holster shell of FIG. 7, showing an anti-rotation plate recess formed in the holster shell, for acceptance of an anti-rotation plate of an embodiment of a locking hood assembly.
Figure 24:
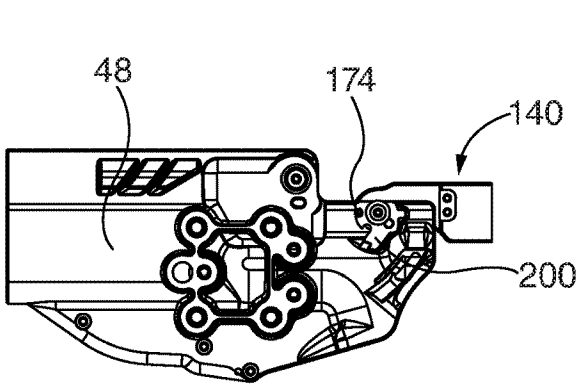
FIGS. 22-24 are plan views of the inboard sidewall of the holster shell of FIG. 1, without the belt hanger and the retention-block release lever, with the hood in its first pivot position above the holster cavity, wherein component layers of the hood are removed sequentially in the figures.
Figure 23:
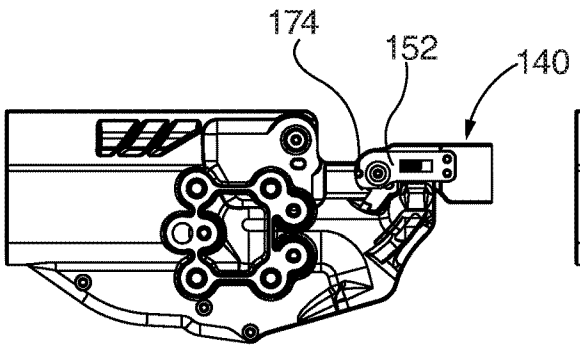

The holster shell embodiment 120 of FIGS. 19-21 receives a handgun with a lower frame- and/or trigger guard-mounted illumination device or other device. The holster cavity 122 of holster shell 120 has a well 124, which receives the illumination device while it is attached to a handgun. During handgun insertion, a muzzle plug 126, with a male tip 128 slidably receives the muzzle of the handgun barrel, while a projecting lip 130, formed in the interior of the rear wall 132 of the holster shell 120 contacts the bottom of the trigger guard and urges it toward the retention block 72. Referring also to FIG. 17, as the handgun barrel receives the male tip 128 of the muzzle plug 126 the latter becomes a pivotal anchoring point for the handgun. In parallel sequence during handgun insertion, the projecting lip 130 urges the handgun trigger guard toward the retention block 72, along with the slide 104, until the ejection port 106 rocks into contact with the handgun engagement surface 108. A handgun biasing element leaf spring 134 is affixed to the muzzle plug 126, and biases the muzzle end of a handgun slide or an exposed barrel into biased engagement with the retention block 72, in similar fashion as the leaf spring 112 of FIGS. 9 and 12. In other embodiments different types of biasing elements are substituted for the leaf spring 134, including without limitation coil springs, resilient compressible polymers, and torsion springs. In some embodiments, the muzzle plug 126 is modular, and selectively coupled to the holster shell 120 by muzzle plug fasteners 136. In some embodiments, different lengths L of the muzzle plug 126 are specified to accommodate different slide and barrel lengths of handguns of the same family, within a common holster shell 120, reducing manufacturing inventory of the number of types of holster shells.

Figure 25:
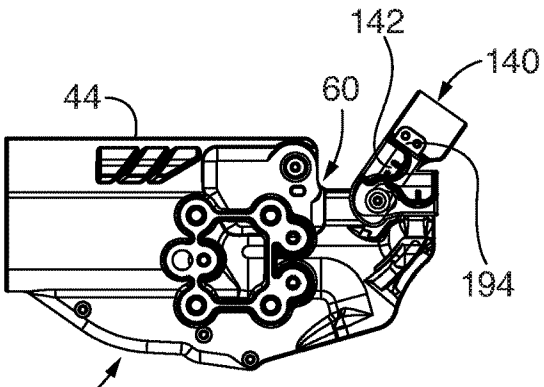

As shown in FIGS. 1-5, 22, and 25, the holster 40 also incorporates a pivoting, locking hood assembly 140, with a hood actuator 142. The hood assembly 140 is selectively pivotable from a first pivot position that blocks insertion into or withdrawal of a handgun from the holster cavity 60 (FIG. 22), to a second pivot position forward of the holster cavity, toward the front wall 44 of the holster 40 that allows such insertion or withdrawal (FIG. 25). In some embodiments, the hood assembly 140 only locks in its first pivot position, while in other embodiments the hood assembly locks in the first and second pivot positions. In yet other embodiments, the hood assembly 140 locks in pivot positions intermediate the first and second pivot positions. Advantageously, the hood assembly 140 has all of the moving components of the hood actuator 142 therein, simplifying the holster shell 42, so that the planar alignment of the hood actuator 142 and the thumb pad 102 of the retention-block release lever 70, parallel to the inboard, first sidewall 48. The planar alignment of the thumb pad 102 and the hood actuator 142 facilitates natural motion of the holster wearer's thumb during a handgun draw stroke. Thus, the holster wearer sequentially manipulates the hood actuator, then the thumb pad 102 while acquiring a firing grip on the handgun.

Various components of the hood assembly 140, without the holster shell, and its range of motion from the first to second pivot positions, are shown in FIGS. 22-39. More specifically, FIGS. 22-24 and 29, 31 and 33 show layers of the components when the hood assembly 140 is locked and oriented in its first position, while FIGS. 25-27, and 30, 32 and 39 show the same layers while the hood assembly is locked and oriented in its second position. FIGS. 36-38 show the hood assembly 140 unlocked and in transition from its first to second pivot positions, as the holster wearer depresses the hood actuator 142.

The hood assembly 140 of FIGS. 29-39 is pivotally coupled to the holster shell 42 by respective concentrically and axially aligned, first 144 and second 146 hood journals. The respective hood journals 144, 146 project from and are retained in first 148 and second 150 apertures in the respective first 48 and second 50 sidewalls; see FIGS. 11, 12 and 28. In some embodiments, the hood assembly 140 is semi-rigid or rigid, with an inverted U-shape that pivots about the hood journals along fixed rotational axes, in order to shield a handgun retained in the holster shell 42 from external impacts, blows, and attempts to snap it off the holster in a violent encounter. The hood assembly 140 includes a non-reciprocating, first hood plate 152, having a first end 154 pivotally coupled to the first journal 144 about the fixed rotational axis, and a second end 156 that is coupled a hood hoop 158. The hood hoop 158 has an inverted J-shaped structure, with a first end forming a non-reciprocating, second hood plate or strap ("second plate/strap") 160 coupled to the second hood journal 146 about the fixed rotational axis, and a second end 162 coupled to the second end 156 of the first hood plate 152 by rivets 164.

The reciprocating hood actuator 142 includes an internal recess 166, which retains the non-reciprocating, first hood plate 152 in track-like fashion. The hood actuator 142 reciprocates relative to the first hood plate 152. Retention tabs 168 restrain the second end 156 of the first hood plate laterally. The first journal 144 and its journal fastener, a retention screw 170, pass through a slot 172 formed in the hood actuator 142, preventing lateral separation of the sandwiched hood actuator, pivoting first end 154 of the first hood plate 152, the holster shell's first sidewall 48 and a yet to be described anti-rotation plate 200. Another fastener 170 prevents lateral separation of the second hood plate 160 of the hood loop 158 from the second hood journal 146. A cylindrical- or pin-shaped pawl 174 is affixed to a distal end of the hood actuator 142 (i.e., the end closest to the first journal 144), normal to its internal recess 166, and generally parallel to the hood assembly 140 pivotal journal axis that is established between the first 144 and second 146 journals. The hood actuator 142 reciprocates along the slot 172 upon application of thumb pressure force $F_A$, while the first hood plate 152 remains stationary about the first journal 144. In a first reciprocated position, the distal end of the hood actuator 142, along with the pawl 174, is oriented closer to the first journal 144 (i.e., higher in FIG. 34) than in a second reciprocated position (i.e., lower in FIG. 36).

Figure 35:
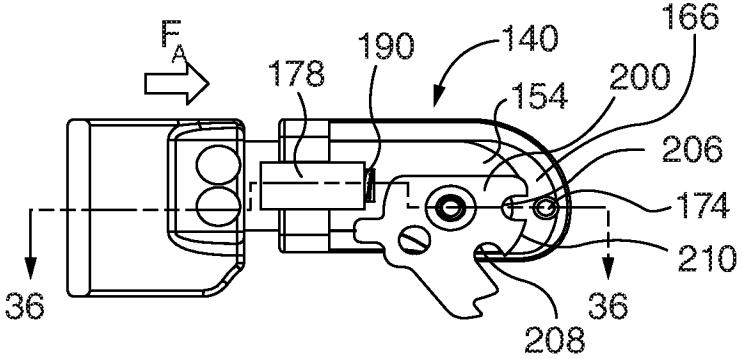
FIG. 35 is a rear elevational view of the hood assembly and its hood actuator in the unlocked, first pivot position.
Figure 36:
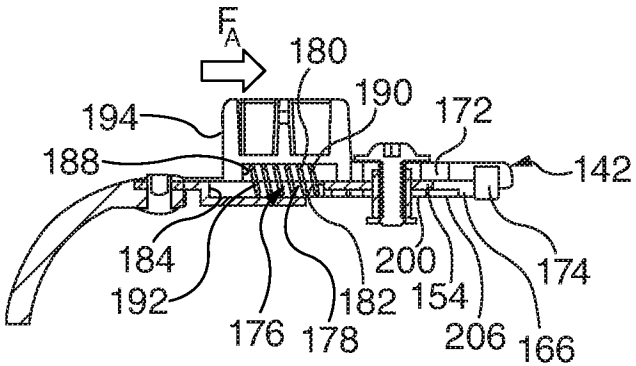
FIG. 36 is an elevational cross section of the hood of FIG. 35, taken along 35-35.
Figure 33:
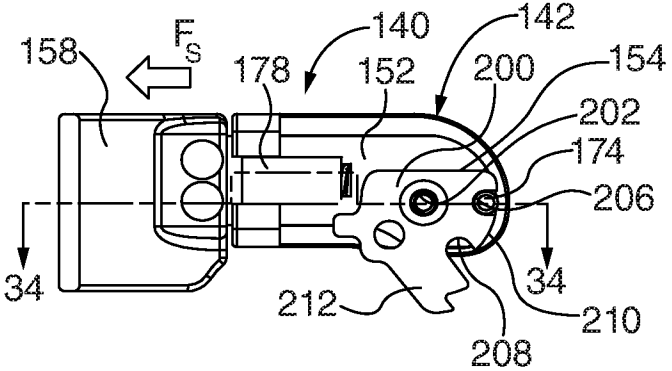
FIG. 33 is a rear elevational view of the hood assembly and its hood actuator in the locked, first pivot position.
Figure 34:
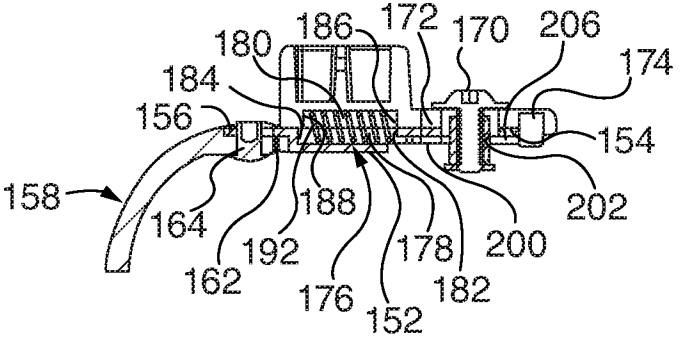
FIG. 34 is an elevational cross section of the hood of FIG. 33, taken along 33-33.

As shown in FIGS. 34-36, the hood actuator 142 is biased into the first reciprocated position by a helical or coil compression spring 176, radially and axially constrained between opposing first 178 and second 180 spring cavities. The first spring cavity 178 is defined within the radially stationary first hood plate 152; it has a lower axial end 182 and an upper axial end 184. The second spring cavity 180 is defined within the reciprocating hood actuator 142; it has a lower axial end 186 and an upper axial end 188. The respective cavities are sized so that the lower end 190 of the compressed spring 176 bears against the lower axial end 182 of the radially stationary, first spring cavity 178, while its upper end 192 bears against the upper axial end 188 of the reciprocating second spring cavity 180. Thus, the coil spring 176 biases the reciprocating hood actuator in an upwardly direction in FIG. 33, parallel to a long axis of the first hood plate 152, with a bias force $F_S$. Biasing force, $F_S$ remains linear throughout the pivotal motion range of the hood assembly 140, because it remains in a constant relative position between the first 178 and second 180 spring cavities. The hood actuator 142 has a thumb release 194, formed on its outer surface. When the thumb release 194 is depressed with force $F_A$, sufficient to overcome the bias force $F_S$ of spring 176, the pawl 174 reciprocates to the second reciprocated position, where the upper end of the slot 172 abuts against the first hood journal 144. While the spring cavity embodiment of FIGS. 33-36 comprises the opposed pair of first 178 and second 180, axially split, cylindrical spring cavities, in other embodiments, the first hood plate's split spring cavity comprises an elongated slot, sandwiched between a pair of axially split, opposing second cavities formed within the hood actuator molding.

Referring to FIGS. 22-28 and 31-36, the hood assembly 140 further comprises an anti-rotation plate 200 that is sandwiched between the outer surface of the first sidewall 48 of the holster shell 42 and the first or lower end 154 of the first hood plate 152, with aperture 202 capturing the first hood journal 144. The first, inboard side 48 of the holster shell 42 defines a recess 204, which receives and prevents rotation the anti-rotation plate 200. The anti-rotation plate 200 defines a first notch 206 and a second notch 208, both of which are dimensioned for slidable insertion of the outer circumference of the pawl 174. The anti-rotation plate 200 defines an arcuate, camming, end surface 210 intermediate the first 206 and second 208 notches, and a first rotational stop surface 212 proximate the second notch. The first rotational stop surface 212 prevents over-rotation of the hood assembly 140, forward of the second pivot position. In the holster embodiment 40 of the figures, the first, inboard sidewall 48 of the holster shell incorporates a raised stop or bumper to prevent over rotation of the hood assembly 140 toward the rear wall 46 of the holster. In other embodiments, not shown, the anti-rotation plate has a second rotational stop surface proximate the first notch to prevent over rotation of the hood assembly toward the rear wall of the holster, in addition to or in lieu of the bumper formed in the inboard sidewall of the holster shell. Besides notches, in other embodiments, other profiles of pawl-receiving indentations are substituted for the notches 206 or 208, such as detents, catches, concave surfaces, or teeth. Other embodiments incorporate non-cylindrical pawl profiles. In various embodiments, the first notch 206 and/or the second notch 208, or other similar notches are formed directly in the holster shell, or in a plate or other notch-defining structure that is embedded within or affixed to the holster shell 42.

When the hood assembly 140 is locked in the first pivot position, blocking the holster cavity 60 (e.g., in FIG. 22), and the hood actuator 142 is in its first reciprocated position, the pawl 174 is engaged in the first notch 206, biased by the compressive spring force $F_S$ generated by the coil spring 176. In embodiments where the hood assembly is only lockable in its first pivot position, the anti-rotation plate 200 is configured with only the first notch 206. Similarly, when the hood actuator 142 is in its first reciprocated position, while the hood assembly 140 is locked in the second pivot position forward of the holster cavity 60 (e.g., in FIG. 25), the pawl 174 is engaged in the second notch 208, biased by the compressive spring force $F_S$ generated by the coil spring 176. The hood assembly 140 is selectively pivoted out of the locked first or second pivot positions by applying thumb pressure $F_A$ to the thumb release surface 194, which reciprocates the pawl 174 to the second reciprocated position of FIGS. 35-37. When the hood is pivoted intermediate the first and second positions, and thumb pressure $F_A$ is eased, the pawl 174 is biased by the spring 176 against the cam-like, arcuate end surface 210 (not shown), which generates a friction or braking resistance to inhibit unrestrained flopping motion of the hood loop.

Figure 4:
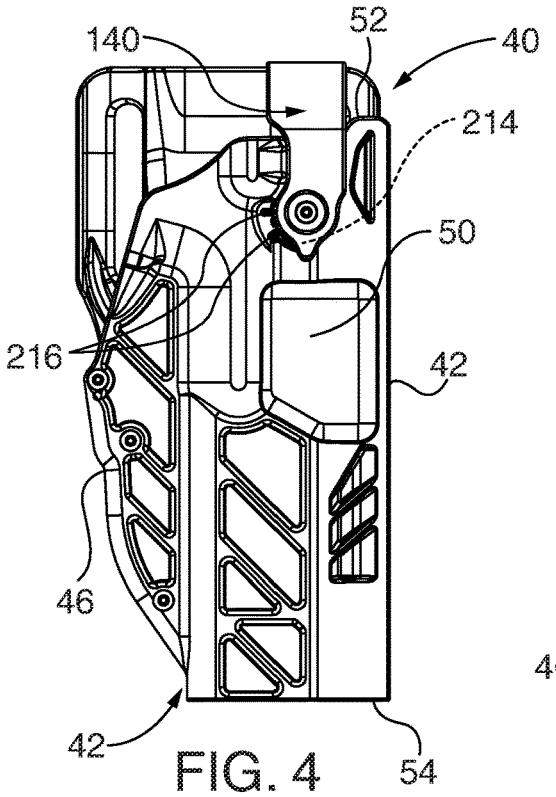
FIG. 4 is an elevational view of the outboard-facing sidewall of the holster of FIG. 1.
Figure 5:
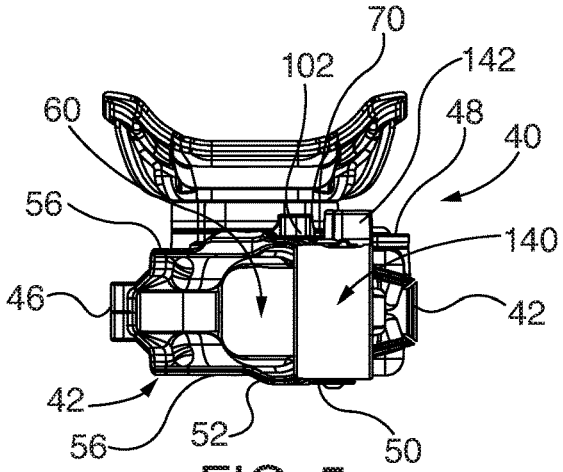
FIG. 5 is a top plan view of the holster of FIG. 1.
Figure 6:
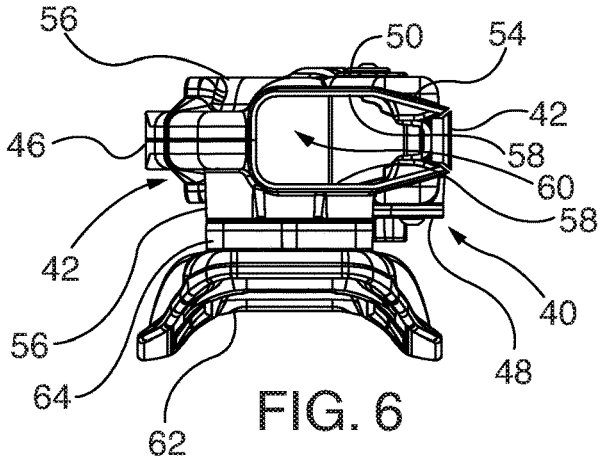
FIG. 6 is a bottom plan view of the holster of FIG. 1.
Figure 7:
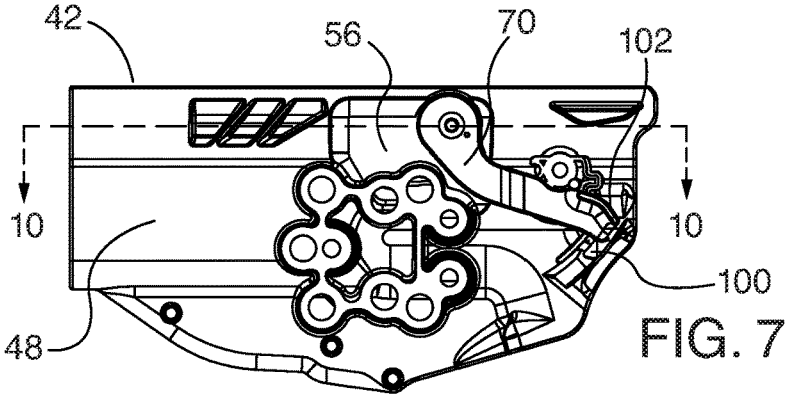
FIG. 7 is a plan view of the inboard sidewall of the holster shell of FIG. 1, without the holster hood and belt hanger, with the retention-block release lever in its locked position.
Figure 8:
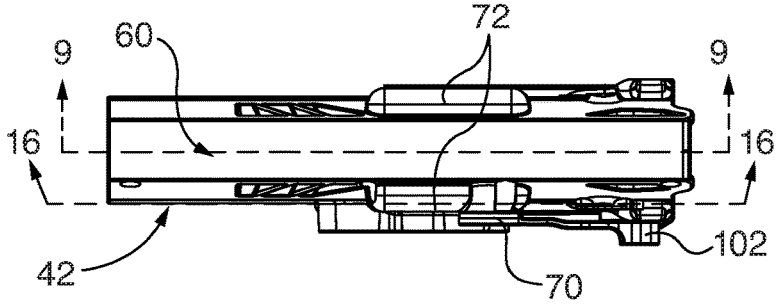
FIG. 8 is a plan view of the front wall of the holster of FIG. 7.

Referring to FIGS. 4, 29 and 30, further frictional resistance is provided by a convex projection 214 on the inwardly facing surface of the second plate/strap 162 and an arcuate array of corresponding, mating, opposed concave depressions 216 formed in the second sidewall 50 of the holster shell facing the second plate/strap. In other embodiments, not shown, the arcuate array of depressions is formed in the second plate/strap and the convex projection is formed in the holster shell. In other embodiments, not shown, respective pairs of a mating convex projection and concave depressions are formed in both of the first hood plate and the second plate/strap and the first and second sidewalls of the holster shell.

In the various embodiments of the holster 40 shown in the figures, the pawl 174 is coupled to the reciprocating hood actuator 142 while the anti-rotation plate 200 with its notches 206, 208 is coupled to the stationary holster shell 42. In other embodiments, those components are reversed: the anti-rotation plate is incorporated in the reciprocating hood actuator while the pawl is coupled to the holster shell. Other embodiments only provide the first notch 206 in the anti-rotation plate 200; the hood assembly is not capable of being locked in the forward, second pivoting position. Other anti-rotation plate embodiments incorporate different combinations of the first and second notches, first and second rotational stops, and/or additional notches along its camming surface.

Figure 22:
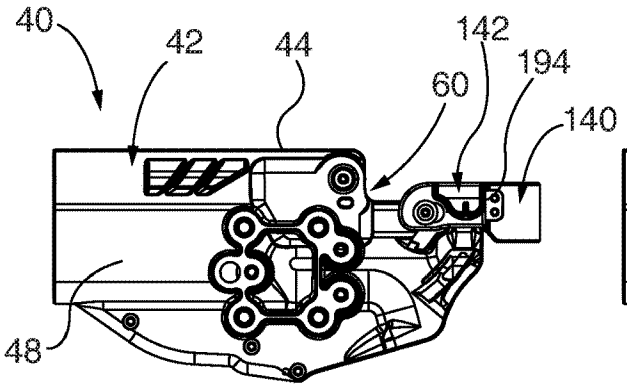
Figure 27:
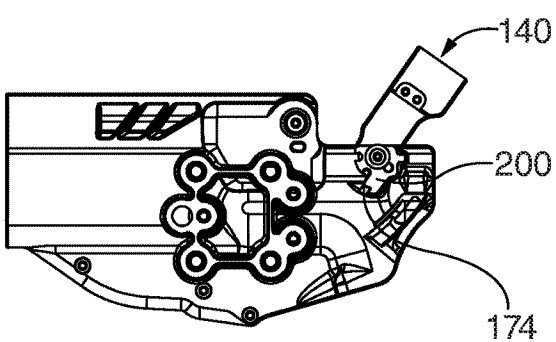
FIGS. 25-27 correspond to plan views of FIGS. 22-24, with the hood in its second pivot position forward of the holster cavity.
Figure 26:
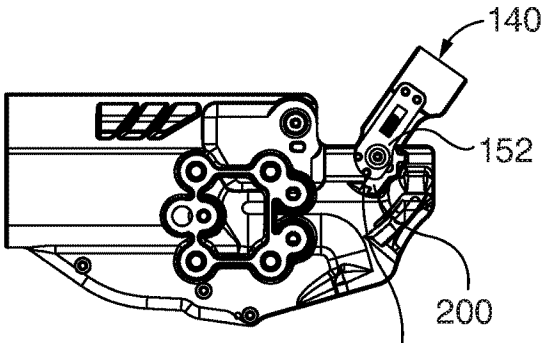

Unlocking and rotating the hood assembly 140 from its first pivot position of FIGS. 22 and 34 to its second pivot position of FIGS. 25 and 38 requires two separate and distinct thumb manipulations on the thumb release surface 194 of the hood actuator 142. Referring to FIGS. 33, 35 and 37-39, spring biasing force $F_S$ generated by the compression spring 176 maintains engagement of the pawl 174 within the notch 206, which is the first reciprocating position of the hood actuator 142. During a draw stroke of the handgun, the user presses down vertically on the thumb release lever 194, as noted by the force arrow $F_A$ in FIG. 35, overcoming the spring biasing force $F_S$, and depressing hood actuator 142 and its the pawl 174 to the second reciprocating position. After the pawl 174 clears the first notch 206, the user rocks the thumb release lever 194 forward with a second thumb manipulation, as noted by the force arrow FR in FIGS. 37 and 38, until the pawl abuts against the first rotational stop 212. Thumb pressure is then released, allowing the spring 176 biasing force $F_S$ to engage the pawl 174 into the second notch 208, returning the hood actuator 142 back to its first reciprocating position.

While the holster 40 incorporates both of the retention block, automatic locking system 68 and the pivoting, locking hood assembly 140, other embodiments incorporate only the automatic locking system or only the hood assembly.

Although various embodiments that incorporate the invention have been shown and described in detail herein, others can readily devise many other varied embodiments that still incorporate the claimed invention. The invention is not limited in its application to the exemplary embodiment details of construction and the arrangement of components set forth in the description or illustrated in the drawings. For example, as noted, orientation of the pawl 174 and anti-rotation plate 200 are reversible, Profiles of the pawl. 174, the anti-rotation plate 200 notches 206, 208 and the camming surface 210 are not restricted to mating cylindrical and parallel jaw sliding surfaces: alternatively they have mating trapezoidal profiles. In various embodiments, the notches 206, 208 and similar pawl-engaging notches are coupled to the holster shell by direct embedding within the holster shell 42, or direct formation within the holster shell 42, or by affixation of plates or similar notch-defining structures to the holster shell 42. The invention is capable of other embodiments and of being practiced or of being carried out in various ways. In addition, it is to be understood that the phraseology and terminology used herein is for the purpose of description and should not be regarded as limiting. The use of "including", "comprising", or "having" and variations thereof herein is meant to encompass the items listed thereafter and equivalents thereof as well as additional items. Unless specified or limited otherwise, the terms "mounted", "connected", "supported", and "coupled" and variations thereof are used broadly and encompass direct and indirect mountings, connections, supports, and couplings. Further, "connected" and "coupled" are not restricted to physical, mechanical, or electrical connections or couplings.

What is claimed is:

1. A holster for selectively retaining a handgun, comprising:

a holster shell having opposing front and rear walls and opposing first and second side walls; said walls collectively defining upper, lower, inner and outer surfaces, the inner surface defining a holster cavity;

a first journal coupled to and projecting from one of the first or second sidewalls;

a hood, selectively pivotable about a fixed journal axis established by the first journal, having a first pivot position above the holster cavity, for blocking insertion into or withdrawal from the holster cavity of a handgun, and a second position forward of the holster cavity, toward the front wall of the holster, for allowing insertion or withdrawal of a handgun, the hood having:

an elongated, non-reciprocating, first hood plate, having a first end pivotally coupled to the first journal about the fixed journal axis, a second end, and a first axis between those respective ends;

a hood actuator, coupled to the non-reciprocating, first hood plate, the hood actuator reciprocable along the first hood plate, from a first reciprocated position, wherein a distal end of the hood actuator is oriented closer to the first journal, and a second reciprocated position, wherein the distal end thereof is oriented farther away from the first journal;

a first spring cavity defined by the first hood plate, intermediate location of the first hood plate coupling with the first journal and its second end;

a second spring cavity, defined by the hood actuator, oriented intermediate the first journal and a proximal end of the hood actuator, in opposing communication with the first spring cavity between the first and second reciprocated positions;

a compression spring, captured within the first and second spring cavities, biasing the second spring cavity and the hood actuator away from the first journal into the first reciprocated position;

a hood pawl or a hood notch coupled to the hood actuator; and a first notch or first pawl coupled to the holster shell, in mating engagement with the corresponding opposing hood pawl or hood notch, when the holster hood is concurrently in the first pivot and first reciprocated positions, and disengaged when the holster hood is in the second reciprocated position.

2. The holster of claim 1, further comprising a second notch or second pawl coupled to the holster shell, in mating engagement with the corresponding opposing hood pawl or hood notch when the holster hood is concurrently in the second pivot and first reciprocated positions, and disengaged when the holster hood is in the second reciprocated position.

3. The holster of claim 1, further comprising:

a thumb release surface coupled to the hood actuator, and biasing force generated by the compression spring oriented parallel with the first axis of the first hood plate.

4. The holster of claim 1, further comprising:

a second journal coupled to, projecting from the other of the first or second sidewalls, and aligned concentrically with the first journal axis;

a U-shaped hood, having a non-reciprocating, first hood plate and a second, non-reciprocating hood plate or strap ("second plate/strap"), in parallel with each other and with conjoined respective second ends, the second plate/strap defining a first end pivotally coupled to the second journal about the fixed journal axis.

5. The holster of claim 4, further comprising:

the hood first plate and the second hood plate/strap oriented outside of the holster shell, with the first and second journals projecting perpendicularly away from the holster shell;

a first convex projection or a first concave depression formed on an inner surface of one or both of the first hood plate or the second hood plate/strap, facing the holster shell;

an array of corresponding, mating, opposed second concave depressions or second concave projections oriented on the first and/or the second side walls of the holster shell facing the hood; and the first convex projection or the first concave depression, oriented on the first hood plate and/or the second hood plate/strap sequentially engaging and disengaging opposed second concave depressions or second concave projections in the corresponding array of the first and/or second sidewalls as the hood pivots between the first and second pivot positions.

6. The holster of claim 1, further comprising the hood pawl coupled to the hood actuator and the first notch coupled to the holster shell.

7. The holster of claim 6, further comprising an anti-rotation plate having the first notch formed therein, coupled to the holster shell.

8. The holster of claim 7, the anti-rotation plate further comprising a first rotational stop surface, for blocking rotation of the hood from the second pivot position further toward the front wall of the holster.

9. The holster of claim 8, further comprising a planar anti-rotation plate circumscribing the first journal, oriented between the holster shell and the hood actuator; and the hood pawl having a distal hood-pawl end projecting from the hood actuator in biased abutting and sliding engagement with a camming surface of the anti-rotation plate as the hood is pivoted between the first and second pivot positions, the compression spring exerting linearly varying biasing force throughout pivoting range of motion of the hood.

10. The holster of claim 9, the camming surface terminating on one end thereof by the first notch and terminating on a second end thereof by a second notch that locks the hood in the second pivot and first reciprocated positions when the hood pawl is engaged therein.

11. The holster of claim 10, further comprising:

the anti-rotation plate retained within a depression formed within the holster shell;

a reciprocation slot formed in the distal end of the hood actuator, circumscribing the first journal; and a first retention screw engaging an axial tip of the first journal, outboard of the anti-rotation plate and the hood actuator, for restraining axial separation of the anti-rotation plate, the hood actuator and the first hood plate from the holster shell.

12. The holster of claim 1, further comprising a retention-block release lever, oriented on the outer surface of the first sidewall of the holster shell, having a thumb pad in planar alignment with a thumb release of the hood actuator.

13. A holster for selectively retaining a handgun, comprising:

a holster shell having opposing front and rear walls and opposing first and second side walls; said walls collectively defining upper, lower, inner and outer surfaces, the inner surface defining a holster cavity;

first and second journals, concentrically aligned along a journal axis, the respective journals coupled to and projecting from the first and second sidewalls;

a U-shaped hood selectively pivotable about the first and second journals, having a first pivot position above the holster cavity, for blocking insertion into or withdrawal from the holster cavity of a handgun, and a second position forward of the holster cavity, toward the front wall of the holster, for allowing insertion or withdrawal of a handgun, the hood having:

a first elongated, non-reciprocating, hood plate, and a parallel, second elongated, non-reciprocating hood plate or hood strap ("second plate/strap") with conjoined respective second ends, a first end of the first hood plate pivotally coupled to the first journal about the fixed journal axis, and a first end of the second hood plate/strap pivotally coupled to the second journal about the fixed journal axis;

a hood actuator, coupled to the non-reciprocating, first hood plate, having a proximal end oriented closer to the second end of the first hood plate and a distal end closer to the first end thereof, the hood actuator defining a first elongated slot circumscribing the first journal that is oriented parallel to the first axis of the first hood plate, intermediate the proximal and the distal ends thereof, the hood actuator reciprocable along the first elongated slot, from a first reciprocated position, wherein the distal end thereof is oriented closer to the first journal, and a second reciprocated position, wherein the distal end thereof is oriented farther away from the first journal;

a first spring cavity defined by the first hood plate, intermediate location of the first hood plate coupling with the first journal and its second end;

a second spring cavity, defined by the hood actuator, oriented intermediate the first journal and the proximal end of the hood actuator, in opposing communication with the first spring cavity between the first and second reciprocated positions;

a compression spring, captured within the first and second spring cavities, biasing the second spring cavity and the hood actuator away from the first journal into the first reciprocated position;

a hood pawl coupled to the hood actuator;

a first notch coupled to the holster shell, in mating engagement with the hood pawl when the holster hood is concurrently in the first pivot and first reciprocated positions, and disengaged when the holster hood is in the second reciprocated position; and a second notch coupled to the holster shell, in mating engagement with the hood pawl when the holster hood is concurrently in the second pivot and first reciprocated positions, and disengaged when the holster hood is in the second reciprocated position.

14. The holster of claim 13, further comprising an anti-rotation plate having the first and second notches formed therein, coupled to the holster shell.

15. The holster of claim 14, further comprising a first stop surface for blocking rotation of the hood from the first pivot position further toward the rear wall and a second stop surface formed in the anti-rotation plate, for blocking rotation of the hood from the second pivot position further toward the front wall of the holster.

16. The holster of claim 14, further comprising a planar anti-rotation plate circumscribing the first journal, oriented between the holster shell and the hood actuator; and the hood pawl having a distal hood-pawl end projecting from the hood actuator in biased abutting and sliding engagement with a camming surface of the anti-rotation plate as the hood is pivoted between the first and second pivot positions.

17. The holster of claim 16, the camming surface terminating on one end thereof by the first notch and terminating on a second end thereof by the second notch.

18. The holster of claim 16, further comprising:

the anti-rotation plate retained within a depression formed within the holster shell; and a first retention screw engaging an axial tip of the first journal, outboard of the anti-rotation plate and the hood actuator, for restraining axial separation of the anti-rotation plate, the hood actuator and the first hood plate from the holster shell.

19. The holster of claim 13, further comprising a retention-block release lever, oriented on the outer surface of the first sidewall of the holster shell, having a thumb pad in planar alignment with a thumb release of the hood actuator.

* * * * *